US008216029B2

(12) United States Patent
Ikoma et al.

(10) Patent No.: US 8,216,029 B2
(45) Date of Patent: Jul. 10, 2012

(54) CUTTING MACHINE

(75) Inventors: Kenji Ikoma, Wakayama (JP); Reiji Arikita, Wakayama (JP)

(73) Assignee: Shima Seiki Mfg., Ltd., Wakayama-shi, Wakayama (JP)

( * ) Notice: Subject to any disclaimer, the term of this patent is extended or adjusted under 35 U.S.C. 154(b) by 290 days.

(21) Appl. No.: 12/679,767

(22) PCT Filed: Sep. 24, 2008

(86) PCT No.: PCT/JP2008/002629

§ 371 (c)(1),
(2), (4) Date: Mar. 24, 2010

(87) PCT Pub. No.: WO2009/041021

PCT Pub. Date: Apr. 2, 2009

(65) Prior Publication Data

US 2010/0199826 A1 Aug. 12, 2010

(30) Foreign Application Priority Data

Sep. 25, 2007 (JP) ..... 2007-248275

(51) Int. Cl.
*B24B 19/16* (2006.01)

(52) U.S. Cl. ..... 451/419; 451/552

(58) Field of Classification Search ..... 451/419, 451/552, 349, 321, 312, 423, 428, 192; 83/471
See application file for complete search history.

(56) References Cited

U.S. PATENT DOCUMENTS 5,775,189 A * 7/1998 Ikoma et al. ..... 83/76.1
7,549,361 B2 * 6/2009 Ikoma ..... 83/615

FOREIGN PATENT DOCUMENTS

JP 07060692 A * 3/1995

* cited by examiner

*Primary Examiner* — Dung Van Nguyen
(74) *Attorney, Agent, or Firm* — Rothwell, Figg, Ernst & Manbeck, P.C.

(57) ABSTRACT

It is an object of the present invention to provide a cutting machine capable of sharpening in such a manner that an angle of a cutting edge can be kept constant. A support block 14 is provided with two arms 14*a*, 14*b* which are spaced at a certain angle, and the arms 14*a*, 14*b* have rotation shafts 12*a*, 13*a* of rotary whetstones 12, 13, respectively, extending upright from the vicinities of the front ends thereof. The rotary whetstones 12, 13 has, at front ends thereof, flat surfaces perpendicular to the rotation shafts 12*a*, 13*a* to sharpen the one side 11*b* and the other side 11*c* of the cutting edge 11*a* of the cutting blade 11, respectively. The whetstone holding mechanism 15 can be moved in parallel linearly or can swing almost linearly, as mainly indicated by the arrow 15*a*, to bring the flat surface 12*b* of the rotary whetstone 12 into contact with the one side 11*b* of the cutting blade 11, as depicted by a broken line, thereby allowing the switch to the sharpening state. Even when the sharpening progresses, since parallelism between the flat abrasive surface 12*b* and the one side 11*b* of the cutting blade and between the flat abrasive surface 13*b* and the other side 11*c* of the cutting blade is kept, the angle of the cutting edge is kept constant.

4 Claims, 10 Drawing Sheets

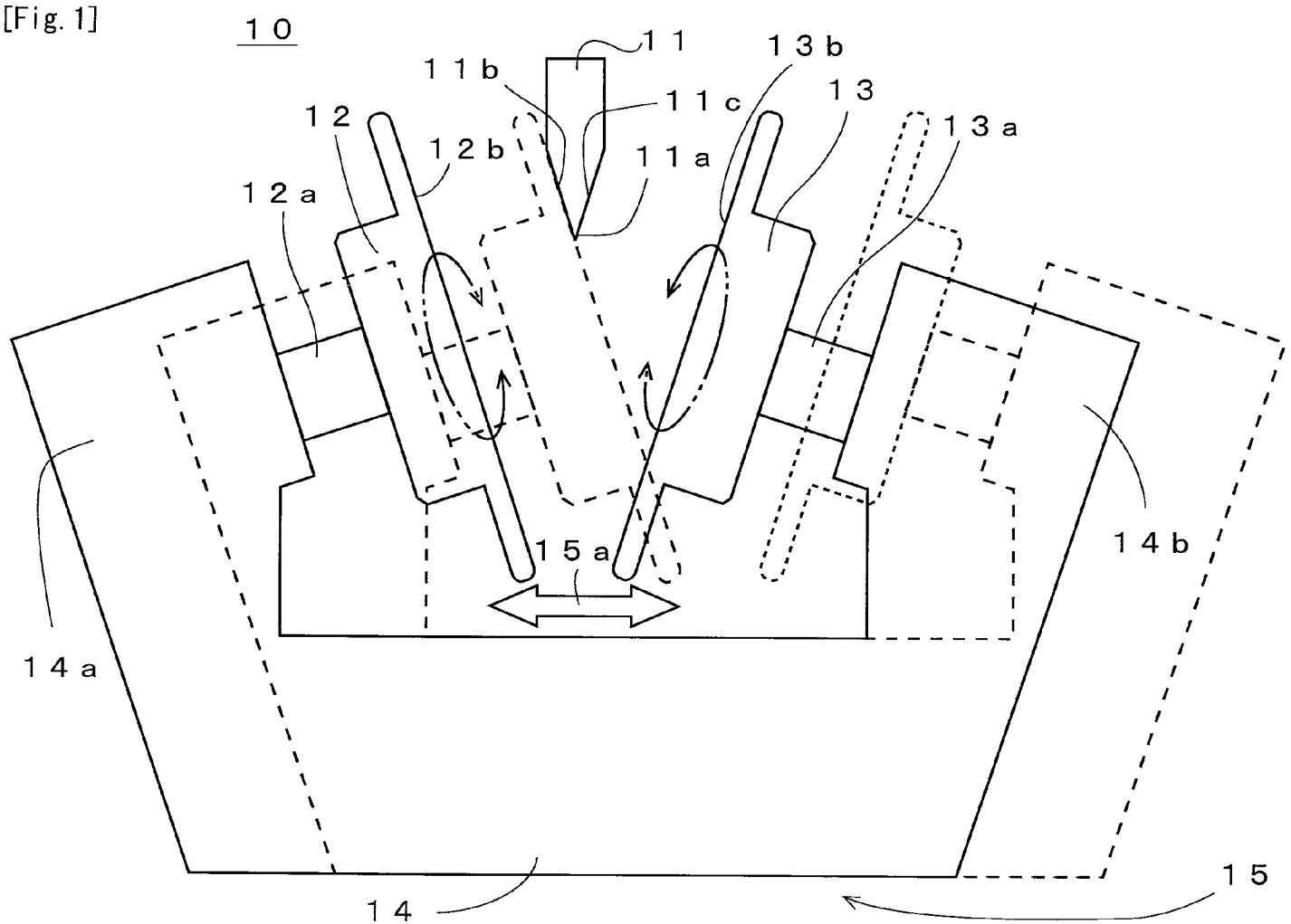
[Fig. 1]

[Fig. 2]
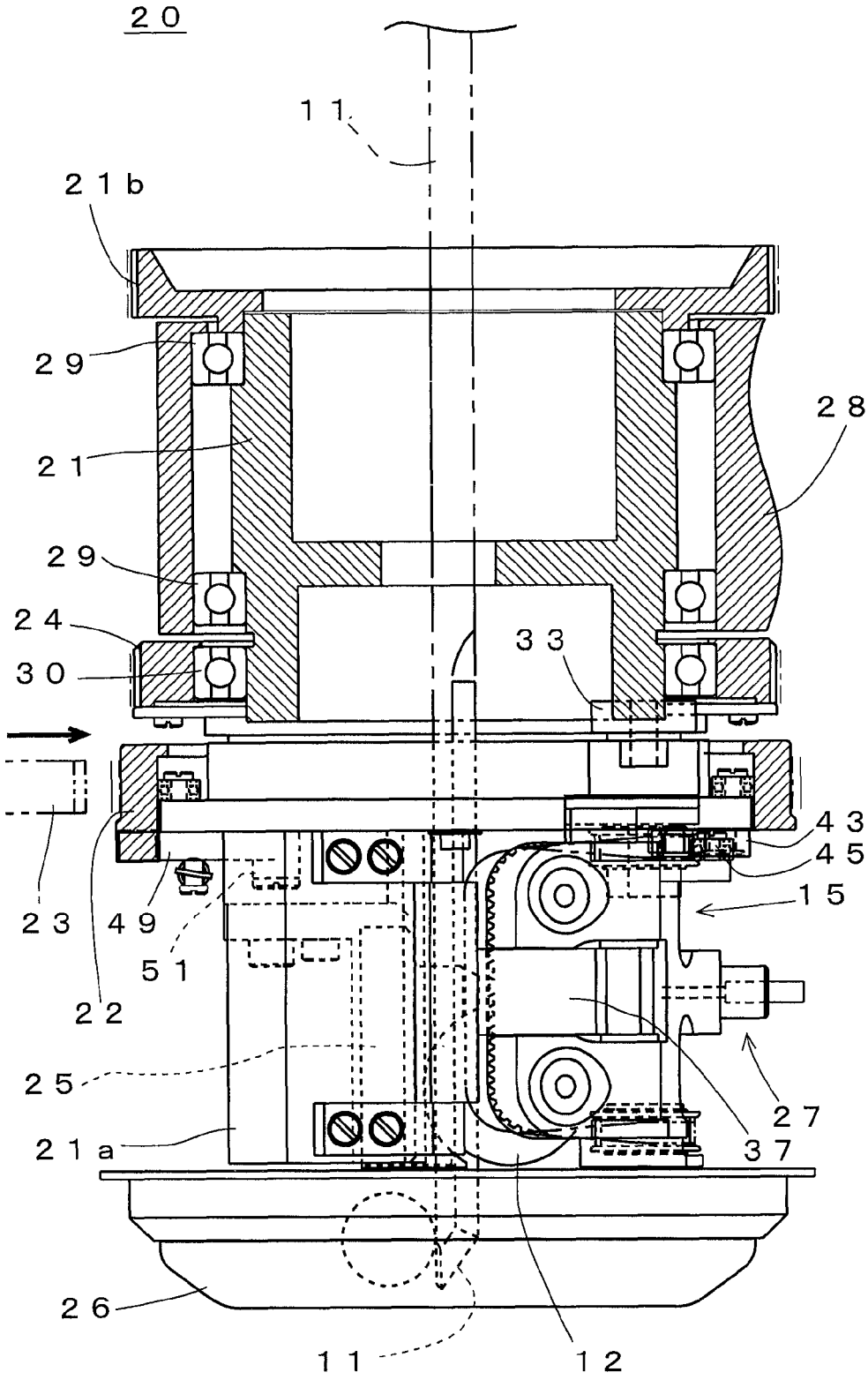

[Fig. 3]
(a)
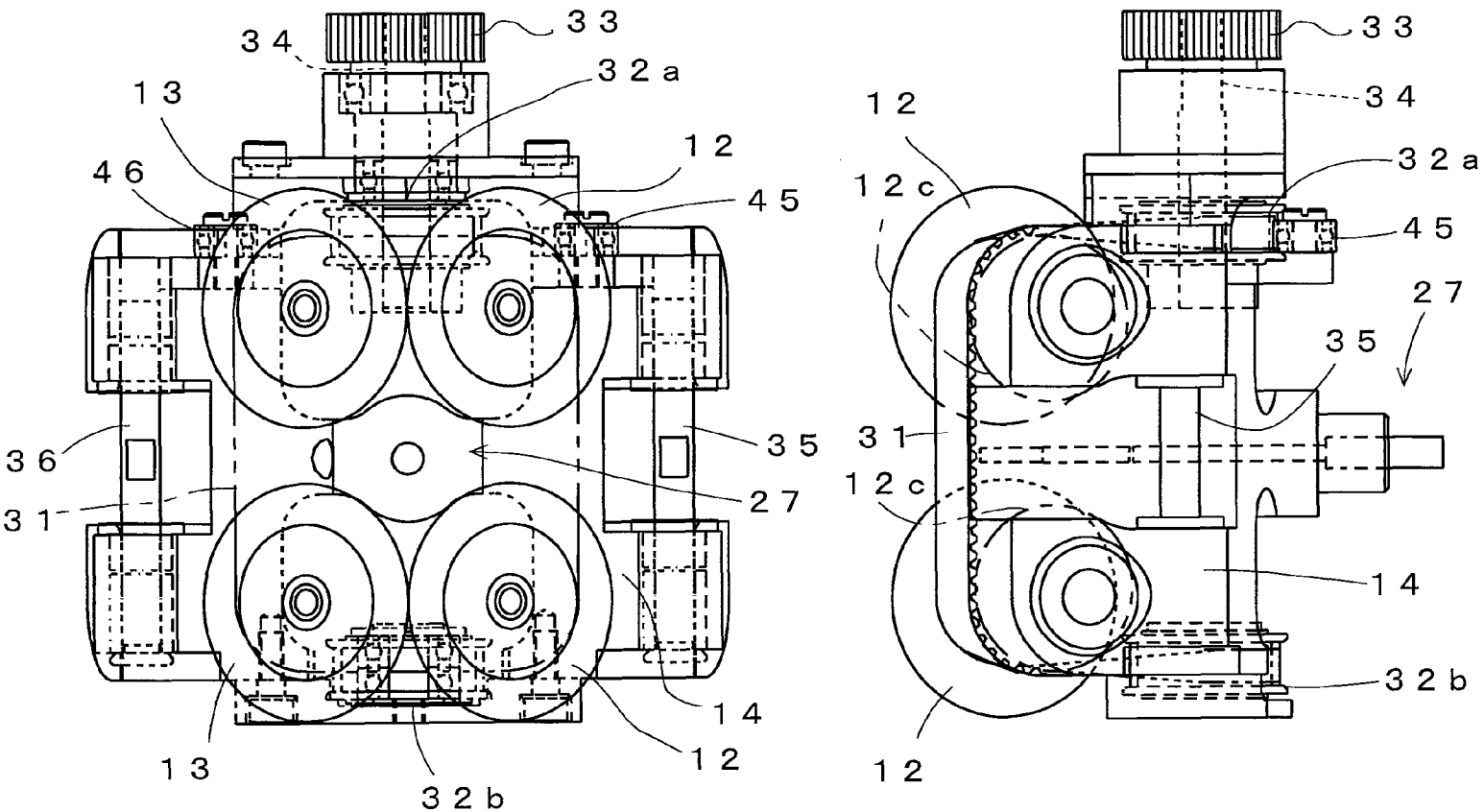
(b)

[Fig. 4]
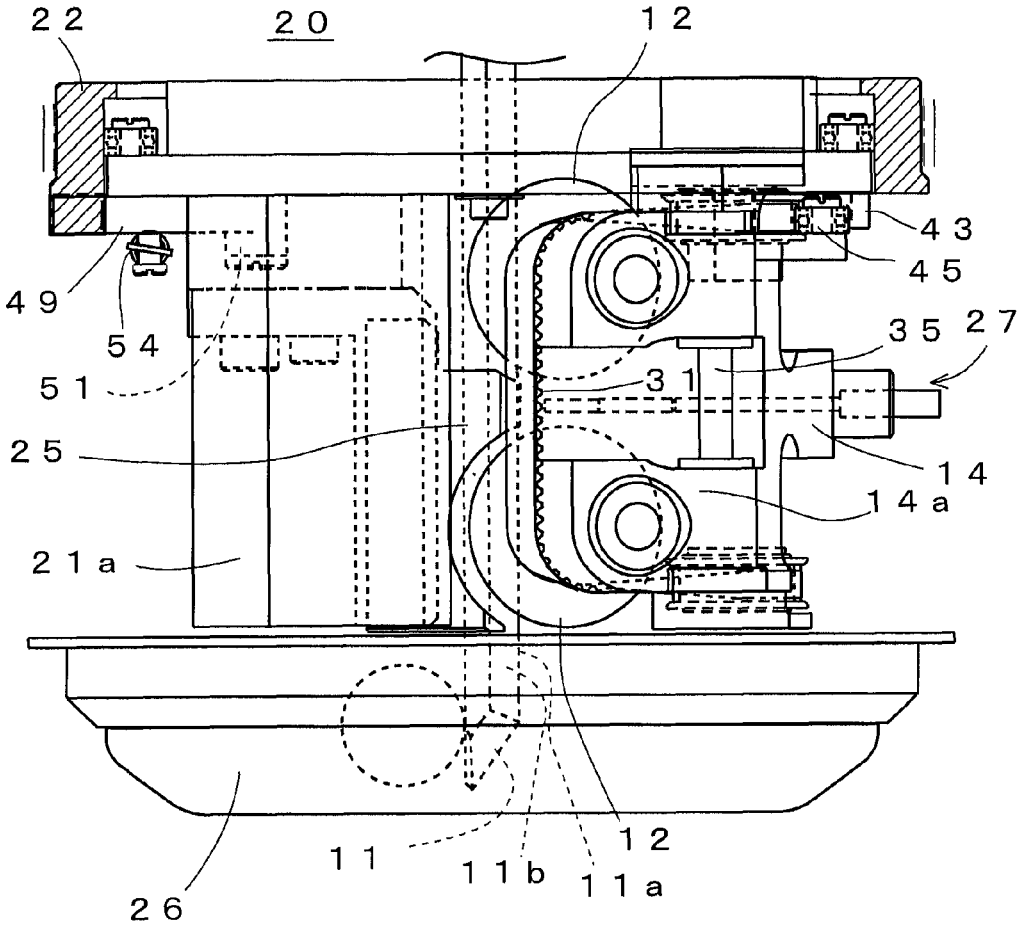

[Fig. 5]
(a)
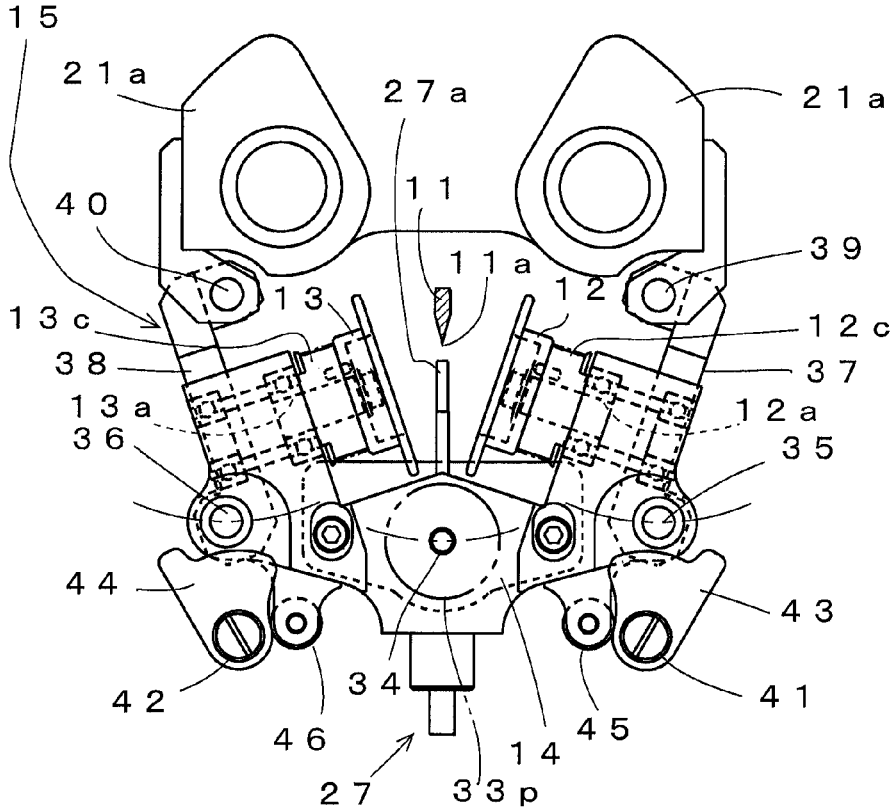
(b)
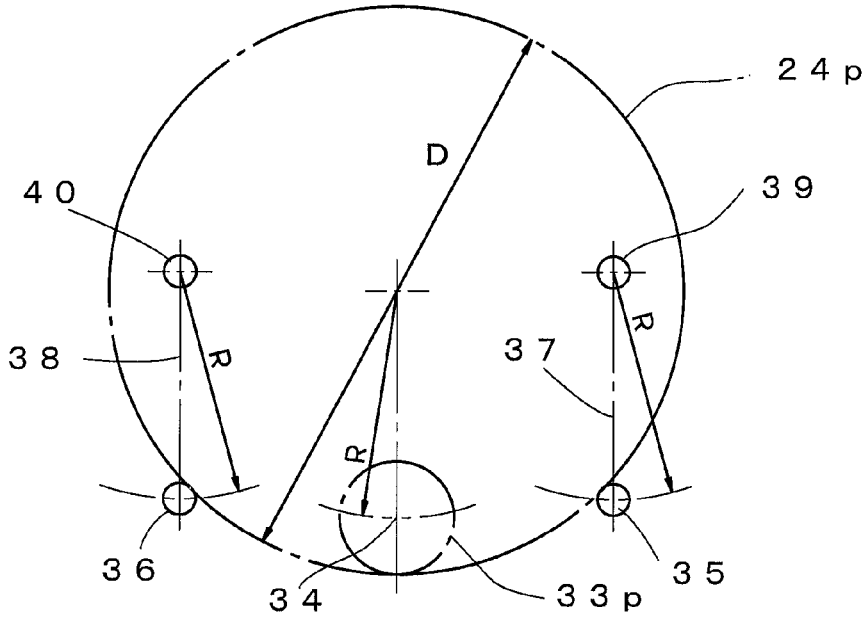

[Fig. 6]
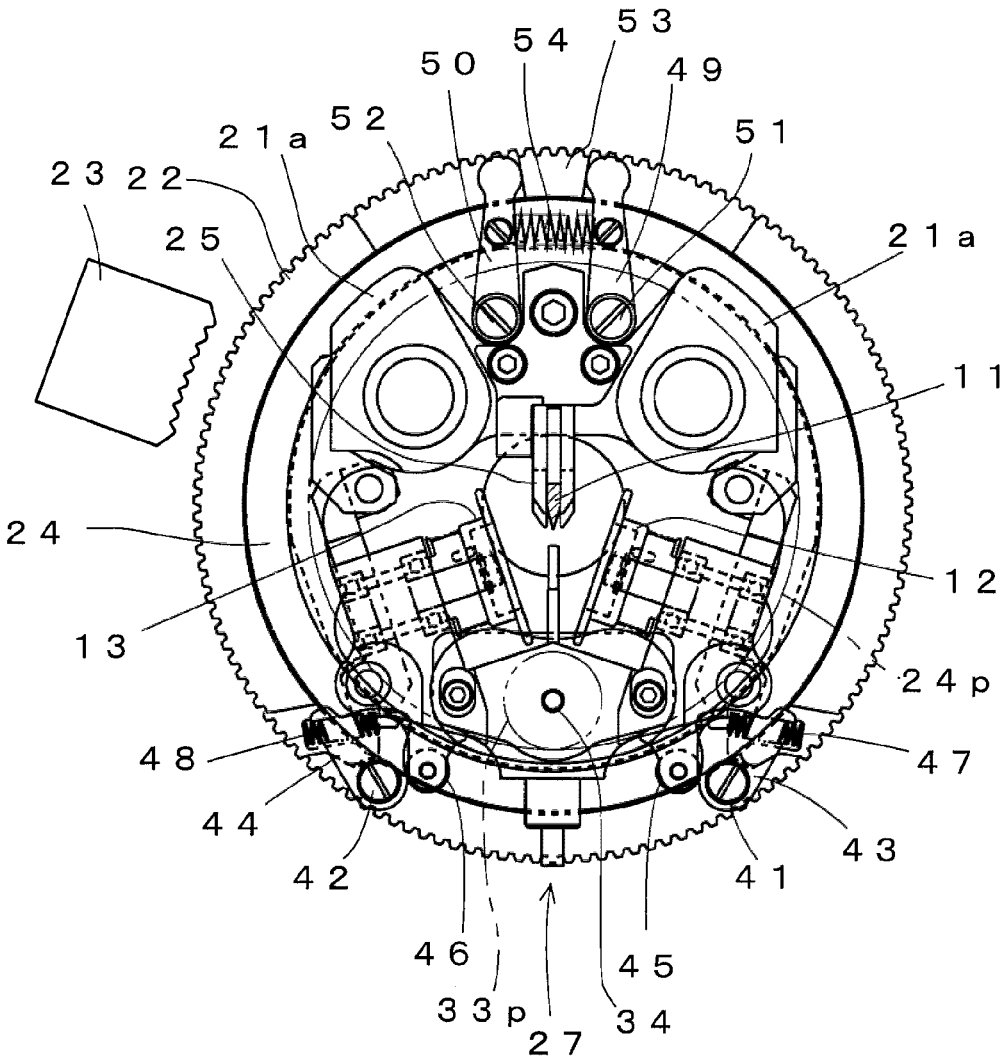

[Fig. 7]
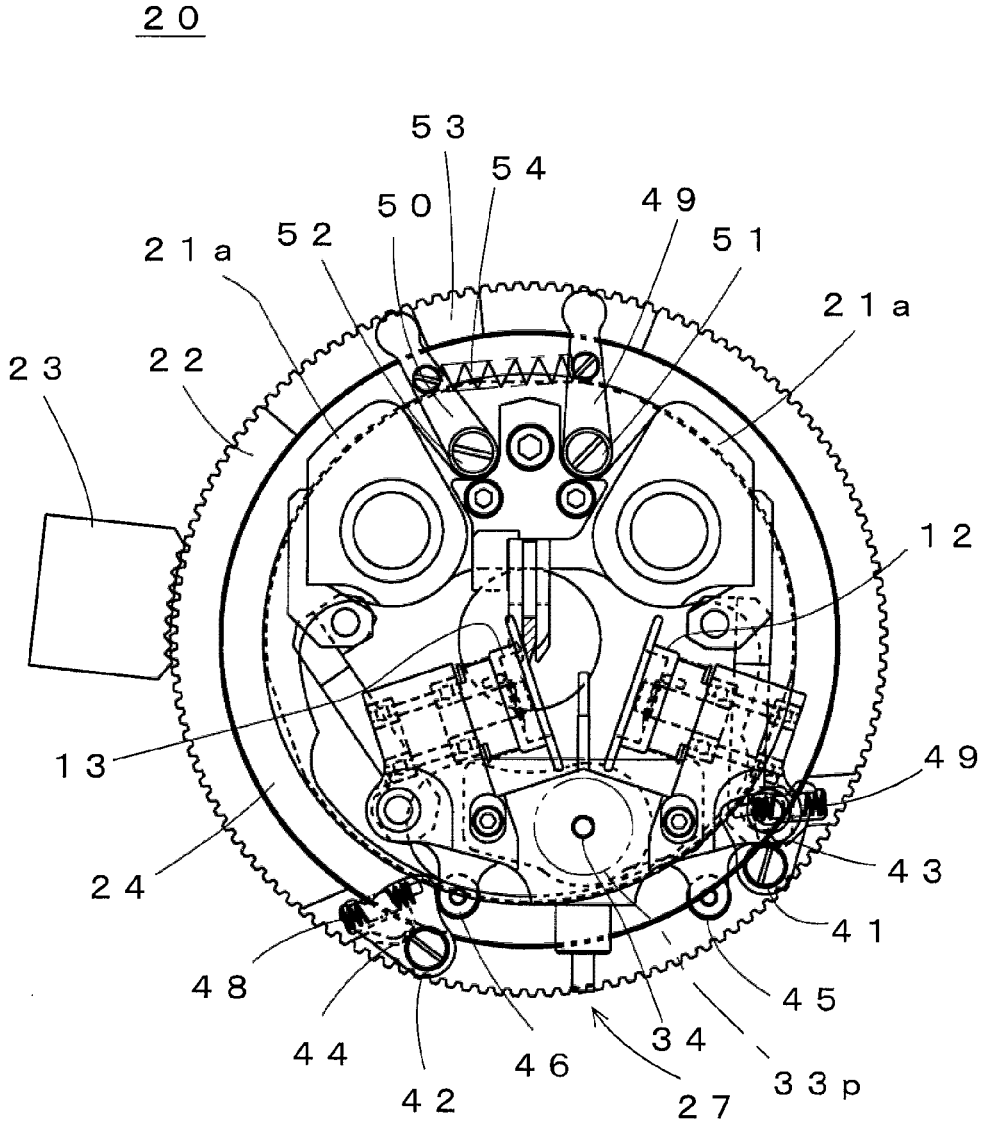

[Fig. 8]
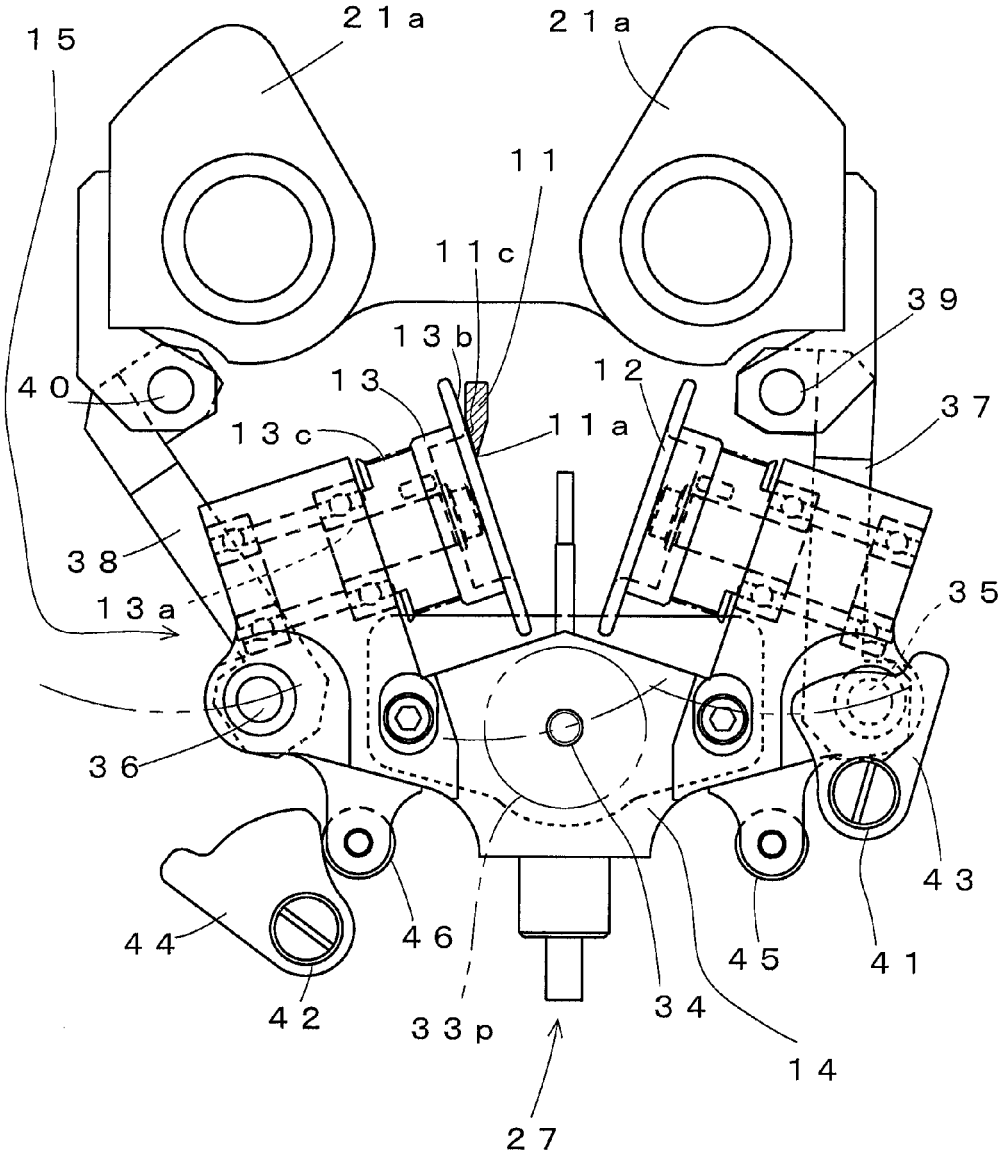

[Fig. 9]
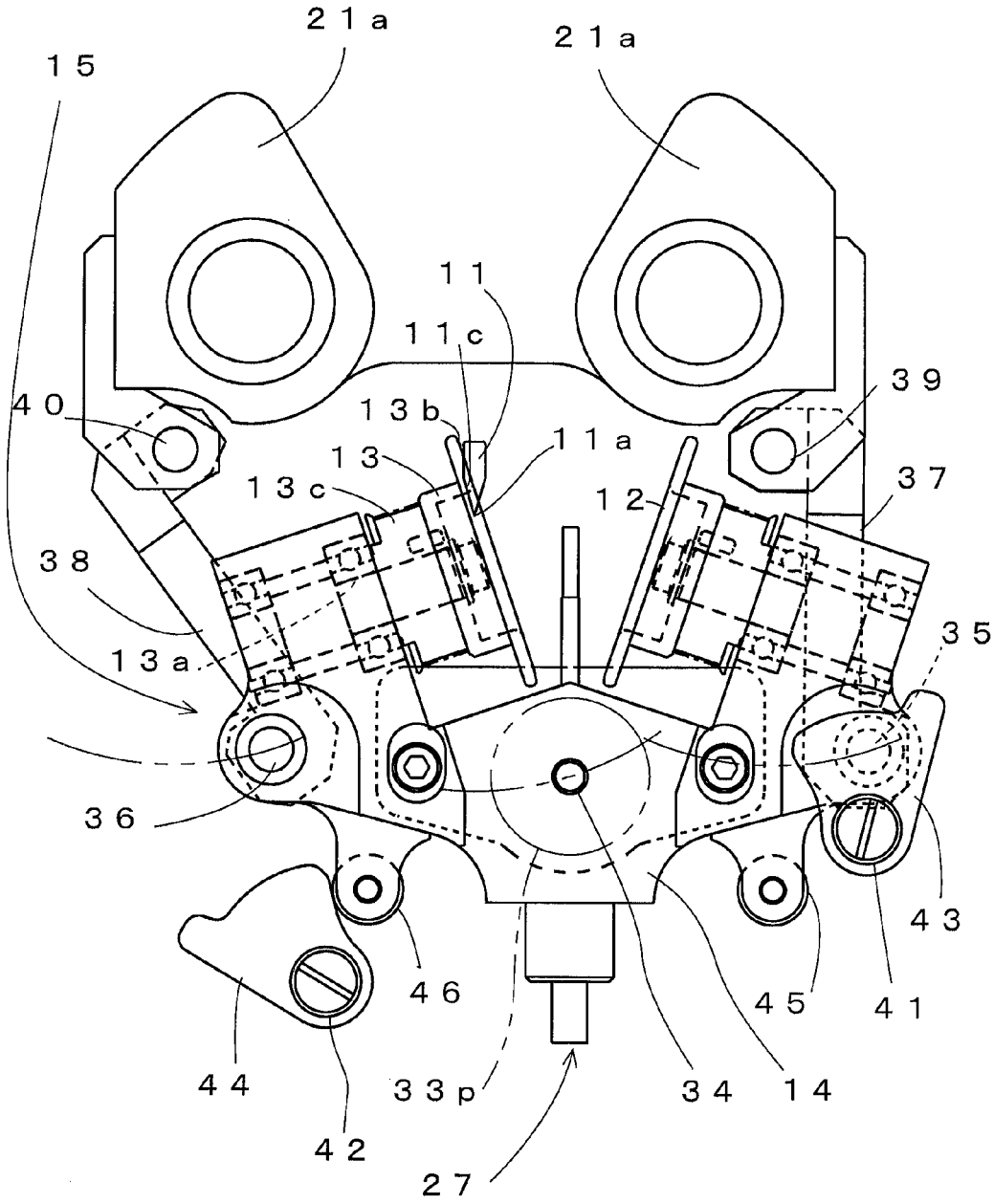

[Fig. 10]
(a)
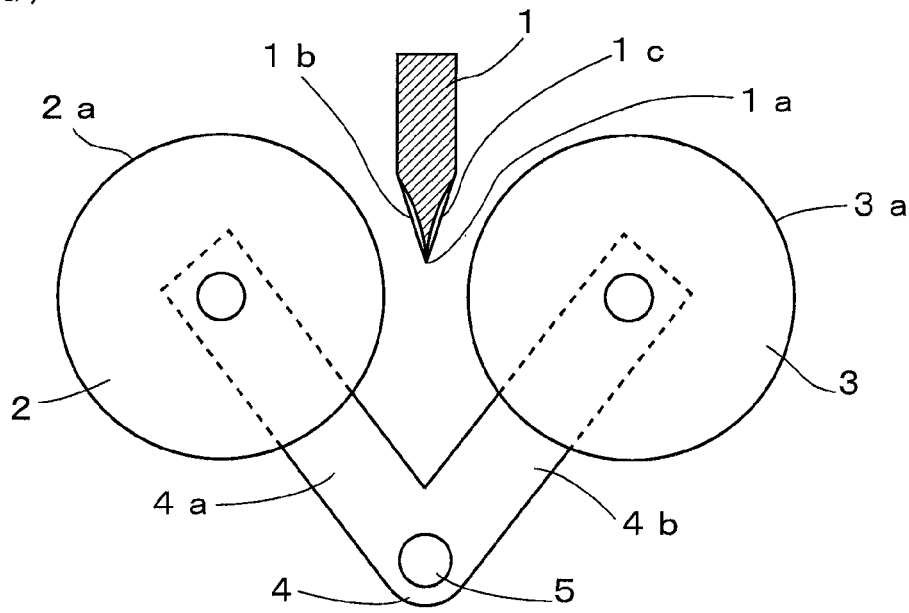
(b)
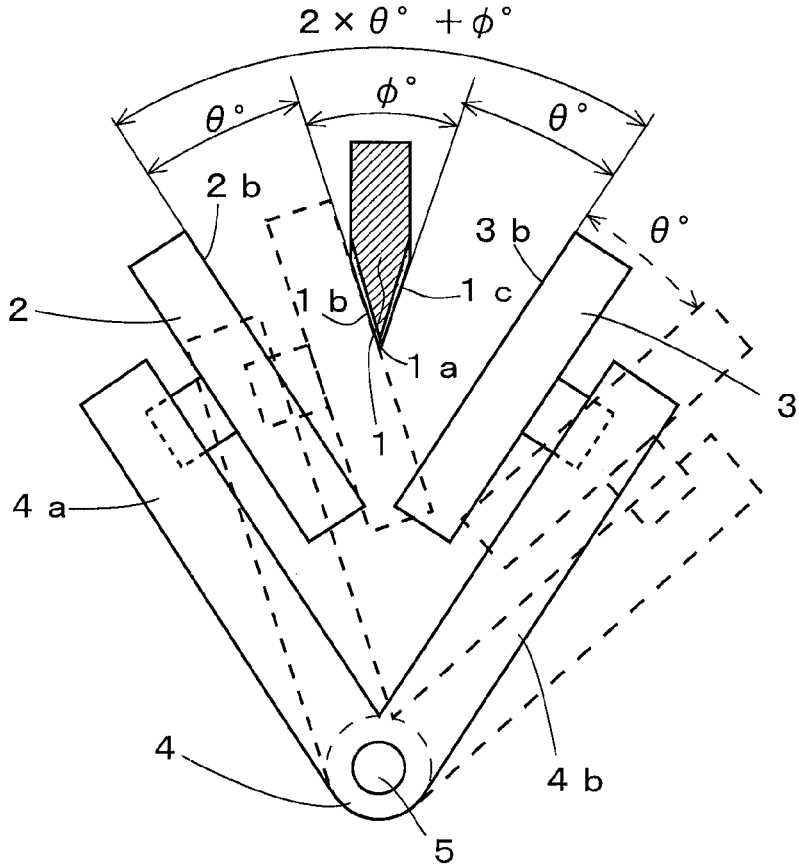

CUTTING MACHINE

CROSS REFERENCE TO RELATED APPLICATION

This application is a 35 U.S.C. 371 National Phase Entry Application from PCT/JP2008/002629, filed Sep. 24, 2008, which claims the benefit of Japanese Patent Application No. 2007-248275 filed on Sep. 25, 2007, the disclosure of which is incorporated herein in its entirety by reference.

TECHNICAL FIELD

The present invention relates to a cutting machine for cutting a sheet material and the like, or particularly to a cutting machine having the function of sharpening a cutting blade.

BACKGROUND ART

In general, when a sheet material such as textile fabric is shaped into sewing parts, the cutting is performed based on a paper pattern or on the data corresponding to the paper pattern. A cutting machine or the like used for the cutting has a sharpening function to keep sharpness of a cutting blade for cutting the sheet material (Cf. Patent Citation 1, for example). The Patent Citation 1 discloses a sheet material cutting machine for cutting the sheet material with a cutting knife which is moved in reciprocation along a vertical axis line and also discloses two different ways of sharpening the cutting knife from both sides of its cutting edge.

FIG. 10 shows those two different concepts on the sharpening disclosed by Patent Citation 1. FIG. 10(*a*) shows one concept on the sharpening with a rounded surface around the outside of a rotary whetstone disclosed in its FIG. 11 and the like. FIG. 10(*b*) shows another concept on sharpening with a flat surface of the rotary whetstone perpendicular to an axis thereof disclosed in its FIG. 13 and the like. In the following, the simplified construction is illustrated, for explanatory convenience. Although names and reference numerals of parts may vary, the correspondence relation to the two different concepts on the sharperning should be obvious.

In FIG. 10(*a*), one side 1*b* of the cutting edge 1*a* of the cutting knife 1 and the other side 1*c* of the same are ground with cylindrical surfaces 2*a*, 3*a* of outer peripheries of two rotary whetstones 2, 3, respectively. The two rotary whetstones 2, 3 are supported at front ends of two arms 4*a*, 4*b* of a support block 4. The two arms 4*a*, 4*b* are fixed with spaced apart from each other at a certain angle. The support block 4 can be pivoted about or swung and displaced around a pivot shaft 5 penetrating intermediate portion between the arms 4*a*, 4*b*. When the support block 4 is pivotally displaced with respect to the pivot shaft 5 in one direction or the other, the one side 1*b* of the cutting knife 1 or the other side 1*c* of the same can be ground with the related cylindrical surface 2*a*, 3*a* of the rotary whetstone 2, 3. In this regard, however, since the sharpening is performed using the cylindrical surface 2*a*, 3*a*, even when one side 1*b* and the other side 1*c* of the knife 1 initially have a linear cross-sectional shape, they are varied in cross-section to have a concave surface, as shown as a shaded area.

In FIG. 10(*b*), like reference numerals are labeled to corresponding parts to FIG. 10(*a*), to avoid redundant explanation. In the support block 4, the arms 4*a*, 4*b* mount the rotary whetstones 2, 3 on the sides facing the cutting edge 1*a* of the cutting knife 1, respectively. Although the rotary whetstones 2, 3 are away from the cutting knife 1 in the full-line state, they can be switched to the state in which the flat surfaces 2*b*, 3*b* perpendicular to the rotation shafts are put in contact with the one side 1*b* and the other side 1*c* of the knife 1, respectively, to sharpen them. For example, when the support block 4 is pivotally displaced in one direction with respect to the pivot shaft 5, the flat surface 2*b* of the rotary whetstone 2 is switched to the state of being put in contact with the one side 1*b* of the cutting knife 1 to sharpen it. Likewise, when the support block 4 is pivotally displaced in the other direction with respect to the pivot shaft 5, the flat surface 3*b* of the rotary whetstone 3 is switched to the state of being put in contact with the other side 1*c* of the cutting knife 1 to sharpen it. As the cutting knife 1 is ground with the flat surfaces 2*b*, 3*b*, the linear cross-sectional shape of the cutting knife 1 is kept unchanged, as shown as the shaded area.

In the sharpening way shown in FIG. 10(*a*), the cylindrical surfaces 2*a*, 2*b* of the rotary whetstones 2, 3 can be put in contact with the one side 1*b* of the cutting edge 1*a* of the cutting knife 1 and the other side 1*c* of the same, respectively, via a link mechanism and the like, not via an overall pivotal displacement of the support block 4 (Cf. Patent Citation 2, for example). According to Patent Citation 2, the rotary whetstones 2, 3 and the whetstone supporting structure are contained in the rotary cylinder which is turned around an R-axis as a rotation shaft of the cutting edge of the cutting blade equivalent to the cutting knife 1. The switching between the sharpening states is performed by turning the rotary cylinder while locking the rotation ring mounted on the rotary cylinder to be stationary relative to outside. A relative angular displacement between the rotation ring stationary with respect to outside and the rotary cylinder able to turn with respect to outside allows the rotary whetstones to pivotally displaced separately via the cams and the link mechanism, thereby allowing the switching between the sharpening states.

Patent Citation 1: JP Patent Publication No. Sho 56-8759
Patent Citation 2: JP Patent No. 3390219

DISCLOSURE OF INVENTION

Technical Problem

FIG. 10(*a*) also shows that when being ground using the cylindrical surfaces 2*a*, 3*a* of the rotary whetstones 2, 3, the one side 1*b* of the cutting edge 1*a* and the other side 1*c* of the same which initially have a linear cross-sectional shape are varied in cross-section to have a concave surface, as shown as the shaded area. The cutting knife having the cross-section thus varied decreases in thickness at its portion close to the cutting edge 1*c* and thus decreases in rigidity, while on the other hand, it sharply increases in thickness at its portion away from such a decreased thickness portion in the vicinity of the cutting edge 1*a*, thereby producing an increased cutting resistance. There may be cases that the cutting knife 1 initially has a face of a curved cross-sectional shape, as shown as the shaded area. Even in this case, as the sharpening with the cylindrical surface 2*a*, 3*a* progresses, the decrease in thickness of the ground area on the side close to the cutting edge 1*a* becomes greater than on the shoulder side farthest from the cutting edge 1*a* and thus an angle of the cutting edge becomes greater. In either case, as long as the cutting knife is ground using the cylindrical surfaces 2*a*, 3*a*, the initial angle of the cutting edge cannot be kept unchanged.

As shown in FIG. 10(*b*), when the cutting knife is ground using the flat surfaces 2*b*, 3*b* of the rotary whetstones 2, 3, the linear cross-sectional shape of the cutting knife may be kept unchanged, as shown as the shaded area. But, since the contact of the flat surfaces 2*b*, 3*b* is caused by the pivotal displacement about the pivot shaft 5, when the sharpening is repeated, both the one side 1*b* and the other side 1*c* vary in angle of inclination, so that the angle of the cutting edge decreases and the rigidity decreases. If it is assumed that an angular displacement of 0° around the pivot shaft 5 is provided for the broken-line sharpening state of the one side 1*b*, then an angular displacement of −0° around the pivot shaft 5 is required for the sharpening state of the other side 1*c*. Where an angle of the cutting edge formed between the one side 1*b* and the other side 1*c* which are converged at the cutting edge 1*a* is set ψ°, it follows that an angle of the space between the flat surfaces 2*b*, 3*b* is 2×θ°+ψ°. This means that the rotary whetstones 2, 3 have to be supported by the support block 4, with their flat surfaces 2*b*, 3*b* spaced at an angle of 2×θ°+ψ°, and the support block 4 must be pivoted about the pivot shaft 5 at an angle of at least ±θ°, thus requiring a large space.

If the arrangement for sharpening with the flat surfaces 2*b*, 3*b* requiring such a large space is supported by the rotary cylinder as is disclosed by Patent Citation 2, then the arrangement will be increased in size. Even if the sharpening with the flat surfaces 2*b*, 3*b* of the rotary whetstones 2, 3 is tried to be performed using the mechanism as disclosed by Patent Citation 2, since the angle at which the flat surfaces 2*b*, 3*b* are put in contact with the one side 1*b* and the other side 1*c* of the cutting edge 1*c* by the pivotal displacement varies with the progress of the sharpening, such modification cannot provide the sharpening in such a manner as to keep the angle of the cutting edge unchanged.

It is an object of the present invention to provide a cutting machine capable of sharpening in such a manner as to keep an angle of the cutting edge constant.

Technical Solution

The present invention provides a cutting machine for cutting a sheet material to be cut, which is put on a cutting table, with a cutting blade provided in a cutting head movable along the cutting table, wherein the cutting blade is used while both sides of its cutting edge are ground to keep sharpness of the cutting edge, and the cutting head is provided with:

a one side use abrasive whetstone for sharpening one side of the cutting edge of the cutting blade with its flat surface, an other side use abrasive whetstone for sharpening the other side of the cutting edge of the cutting blade with its flat surface, and a whetstone holding mechanism that can allow selective switch between a standby state in which the one side use abrasive whetstone and the other side use abrasive whetstone are away from any of the one side of the cutting edge and the other side of the same, while the flat surface of the one side use abrasive whetstone and that of the other side use abrasive whetstone are kept in parallel with the one side of the cutting blade and the other side of the same, respectively, and an one side sharpening state in which the one side use abrasive whetstone is put in contact with the one side of the cutting edge or an other side sharpening state in which the other side use abrasive whetstone is put in contact with the other side of the cutting edge, the whetstone holding mechanism includes:

a pair of pivot shafts arranged to stand at both sides of the cutting edge of the cutting blade in spaced relation and perpendicular to the surface of the cutting table;

a pair of swing arms supported capable with swing displacement at base end portions thereof by one and the other of the pivot shafts respectively; and a support block, which is connected to support shafts at front ends of the swing arms and is supported by a four-joint link structure with the centers of the pivot shafts and the centers of the support shafts as joints, holding the flat surfaces, used for sharpening, of the one side use abrasive whetstone and the other side use abrasive whetstone parallel to the one side of the cutting blade and the other side thereof respectively.

In the cutting machine according to the present invention, said cutting head comprises:

a rotary cylinder containing the cutting blade and being capable of turning around a rotation shaft of the cutting edge perpendicular to a surface of the cutting table, to change a cutting direction of the cutting blade;

a slide ring provided on a peripheral side of the rotary cylinder so that it can follow the rotary cylinder turning in a turning direction; and a lock mechanism provided at a radial outside of the rotary cylinder so that it can lock the slide ring to the cutting head;

said whetstone holding mechanism is provided in the rotary cylinder to allow the selective switch between the standby state, and the one side sharpening state or the other side sharpening state according to a turning angle of the rotary cylinder around the rotation shaft of the cutting edge when the slide ring is locked by the lock mechanism.

In the cutting machine according to the present invention, said whetstone holding mechanism is arranged in the rotary cylinder in standing relation, and said slide ring is provided with cams for guiding the whetstone holding mechanism to positions corresponding to the standby state, the one side sharpening state, and the other side sharpening state, respectively.

In the cutting machine according to the present invention, said rotary cylinder is provided with a rotation ring which can be rotationally driven from outside and has an internal tooth around an inside thereof, said whetstone holding mechanism is equipped with a gear to engage with the internal tooth of the rotation ring, said cams are formed to guide the whetstone holding mechanism in such a manner as to change a position of the whetstone holding mechanism while keeping the engagement between the gear and the internal tooth of the rotation ring, and said one side use abrasive whetstone and said other side use abrasive whetstone are rotated by a rotational driving force transmitted from outside of the rotary cylinder to the gear through the rotation ring, to sharpen the cutting blade.

Advantageous Effects

According to the present invention, since the flat abrasive surface of the one side use abrasive whetstone and the flat abrasive surface of the other side use abrasive whetstone are kept in parallel with the one side of the cutting blade and the other side of the same, respectively, by the whetstone holding mechanism provided in the cutting head, the sharpening can be carried out in such a manner as to keep an angle of the cutting edge constant.

According to the present invention, the cutting blade sharpening elements are contained in the rotary cylinder able to turn around the rotation shaft of the cutting edge, and the selective switch between the sharpening states can be made at an angle of rotation of the rotary cylinder in the state in which the slide ring is locked by the lock mechanism.

According to the present invention, since the whetstone holding mechanism is supported in spaced relation on front ends of a pair of swing arms which are supported capable with swing displacement at base end portions thereof to the rotary cylinder in spaced relation, a four-joint link mechanism is formed, respective sides of which are formed by the rotary cylinder, the pair of swing arms, and the whetstone holding mechanism. Since the front end portions of the swing arms are guided via this four-joint link mechanism, the mechanism for moving the one side use abrasive whetstone and the other side use abrasive whetstone, which are held by the whetstone holding mechanism, while keeping the state in which an angle formed between the both flat surfaces used for the sharpening corresponds to an angle of the cutting edge, can be made compact.

According to the present invention, the one side use abrasive whetstone and the other side use abrasive whetstone can be rotationally driven from outside of the rotary cylinder.

BRIEF DESCRIPTION OF DRAWINGS

FIG. 1 shows a partially sectioned plan view of a cutting machine 10 of an embodiment of the present invention, simplistically showing a construction for sharpening a cutting blade 11.

FIG. 2 shows a front sectional view showing a schematic construction of a cutting head 20 used in the cutting machine 10 of FIG. 1.

FIG. 3 shows a front view and a left side view showing a construction of a whetstone holding mechanism 15 of FIG. 2.

FIG. 4 shows a front view showing a cutting blade 11 sharpening construction of FIG. 2 from which a pivoted arm 37 and some other parts are omitted.

FIG. 5 shows a partial plan view of the whetstone holding mechanism 15 and the cutting blade 11 of FIG. 2 which are in the standby state for sharpening and also shows a positional relation between four joints of a link system for supporting the whetstone holding mechanism 15.

FIG. 6 shows a plane section view showing the construction of the cutting head 20 of FIG. 2 which is in the state in which a slide ring 22 is not locked by a lock mechanism 23.

FIG. 7 shows a plane section view showing the construction of the cutting head 20 of FIG. 2 which is in the state in which the slide ring 22 is not locked by the lock mechanism 23.

FIG. 8 shows a partially sectioned plan view showing the relation between the whetstone holding mechanism 15 and the cutting blade 11 of FIG. 6.

FIG. 9 shows a partially sectioned plan view showing the state in which a rotary cylinder 21 is in contact with the cutting blade 11 at an angle of 16° by being angularly changed further with respect to the slide ring 22 of FIG. 7.

FIG. 10 shows sectional views showing simplified illustrations of two different known concepts on the sharpening of the cutting edge.

EXPLANATION OF REFERENCE

10 Cutting machine
11 Cutting blade
11*a* Cutting edge
11*b* One side
11*c* Other side
12, 13 Rotary whetstone
12*b*, 13*b* Flat surface
14 Support block
15 Whetstone holding mechanism
20 Cutting head
21 Rotary cylinder
21*a* Leg
22 Slide ring
23 Lock mechanism
24 Rotation ring
25 Knife guide
28 Support frame
33 Gear
35,36 Support shaft
37,38 Swing arm
39, 40, 41, 42, 51, 52 Pivot shaft
43, 44 Pivoted cam
45, 46 Follower
49, 50 Lever
53 Projecting portion

BEST MODE FOR CARRYING OUT THE INVENTION

FIG. 1 shows a cutting machine 10 of an embodiment of the present invention, simplistically showing a construction for sharpening a cutting blade 11. The cutting blade 11 has a cutting edge 11*a* formed by one slant side surface 11*b* and the other slant side surface 11*c* being joined together at their tips and has a pentagonal cross-sectional shape. The cutting blade 11 is driven to move in reciprocation in a direction perpendicular to paper and can cut a sheet material to a direction for the cutting edge 11*a* to point. A cutting head including a mechanism to support and drive the cutting blade 11 is moved in parallel with and over a cutting table on which the sheet material is carried so that the sheet material can be cut with the cutting edge 11*a* shifted in position or changed in direction to point.

The cutting head is provided therein with a whetstone holding mechanism 15, placed in front of the cutting edge 11*a* of the cutting blade 11, for holding a pair of rotary whetstones 12, 13 via a support block 14. The support block 14 is provided with two arms 14*a*, 14*b* spaced at a certain angle, and rotation shafts 12*a*, 13*a* of the rotary whetstones 12, 13 extend upwards from the vicinities of front ends of the arms 14*a*, 14*b*, respectively. The rotary whetstones 12, 13 have, at front ends thereof, flat surfaces 12*b*, 13*b* perpendicular to the rotation shafts 12*a*, 13*a* to sharpen the one side 11*b* and the other side 11*c* of the cutting edge 11*a* of the cutting blade 11, respectively. The whetstone holding mechanism 15 can move in parallel linearly or can swing almost linearly, as mainly indicated by Arrow 15*a*, to bring the flat surface 12*b* of the rotary whetstone 12 into contact with the one side 11*b* of the cutting blade 11, as depicted by a broken line, thereby switching to the sharpening state. Likewise, when the other side 11*c* of the cutting blade 11 is ground with the flat surface 13*b* of the rotary whetstone 13, the whetstone holding mechanism 15 can move while keeping the one side 11*b* or the other side 11*c* of the cutting edge 11*a* of the cutting blade 11 in parallel with the flat surface 12*b*, 13*b* of the rotary whetstone 12, 13, to allow the selective switch between those sharpening states. Even when the process of sharpening progresses, since the parallelism between the flat surface 12*b*, 13*b* and the one side 11*b* or the other side 11*c* of the cutting blade is kept, the angle of the cutting edge is kept constant.

FIG. 2 shows a schematic construction of the cutting head 20 used in the cutting machine 10 of FIG. 1. The cutting head 20 includes the drive mechanism, placed over the cutting blade 11, for driving the cutting blade 11 in reciprocation, though omitting illustration. The turning of a rotary cylinder 21 allows the cutting blade 11 to turn around the R-axis as a cutting edge turning axis, to change the direction of cutting. A slide ring 22 is provided under the rotary cylinder 21, and a lock mechanism 23 is provided at the outside of the slide ring 22 so that the slide ring 22 can be locked to outside. When being not locked by the lock mechanism 23, the slide ring 22 follows the rotary cylinder 21 turning. To allow the selective switch between the sharpening states by the whetstone holding mechanism 15 as shown in FIG. 1, the slide ring 22 is locked by the lock mechanism 23 so that only the rotary cylinder 21 is turned.

There is provided a rotation ring 24 over the slide ring 22 and under the rotary cylinder 21. The rotary cylinder 21 has legs 21*a* extending downwards through the slide ring 22 and supporting a knife guide 25 thereon. The knife guide 25 supports the cutting blade 11 so that the cutting blade 11 can be prevented from being deformed or displaced when moved vertically. The legs 21*a* support a foot presser 26 at lower ends thereof. The foot presser 26 is to be put on the sheet material to be cut and the like. The whetstone holding mechanism 15 is supported at a position opposed to the knife guide 25 via a front end portion of a swing arm 37 and the like, as mentioned later. The swing arm 37 is supported at a base end thereof by the leg 21*a* to be freely pivoted. The whetstone holding mechanism 15 includes a cutting edge position detecting mechanism 27 for detecting a position of the cutting edge 11*a* of the cutting blade 11 and also detecting wear of the cutting blade 11 caused by the sharpening and the cutting of the cutting blade 11. The rotary cylinder 21 is supported by a support frame 28 of the cutting head 20 to be freely rotatable via a bearing 29. The lock mechanism 23 locks so that the slide ring 24 can be made stationary with respect to the support frame 28. The rotary cylinder 21 mounts thereon a pulley 21*b* to receive a rotational driving force from outside. The rotation ring 24 is supported to the rotary cylinder 21 via a bearing 30. A timing belt is wound around the rotation ring 24 to receive the rotational driving force to rotate the rotary whetstone 12, 13 via a gear 33 meshed with an internally-toothed gear. The details on the gear 33, a slide ring pivoted cam 43, a follower 45, a lever 49, and a pivot shaft 51 are described later.

FIG. 3 shows the construction of the whetstone holding mechanism 15 of FIG. 2. FIG. 3(*a*) shows the construction as viewed from the left side of FIG. 2 and FIG. 3(*b*) shows the construction as viewed from the front side of FIG. 2. The rotary whetstones 12, 13 are arranged at vertically spaced places, two at each side of the mechanism. The rotary whetstone 12 is provided at a base portion thereof with a pulley 12*a*, around which a timing belt 31 is wound. The rotary whetstone 13 is also provided with a pulley 13*c*, as mentioned later. The single timing belt 31 in total runs around the rotary whetstones 12, 13 and upper and lower pulleys 32*a*, 32*b*. The upper pulley 32*a* is fixed to a lower end portion of a drive shaft 34 mounting the gear 33 on an upper end thereof. The lower pulley 32*b* rotates freely. The support block 14 is provided with support shafts 35, 36 and followers 45, 46 which are respectively arranged at spaced places.

FIG. 4 shows the construction of sharpening the cutting blade 11 of FIG. 3 from which a swing arm 37 and some other parts are omitted. The knife guide 25 has a shape not to contact with the rotary whetstone 12 at the position where the cutting blade 11 is sharpened. At the time of sharpening, the cutting blade 11 is moved vertically a stroke so that it can be uniformly sharpened in the longitudinal direction. One end of a tension spring 54 mentioned later is fixed to the lever 49.

FIG. 5 shows the whetstone holding mechanism 15 and the cutting blade 11 of FIG. 2 which are in the standby state for sharpening. Each of the following drawing figures shows the construction of the rotary cylinder 21 as viewed from below the downwardly extending legs 21*a*. FIG. 5(*a*) shows the construction in which the whetstone holding mechanism 15 is supported via a link mechanism. FIG. 5(*b*) shows a positional relation between four joints of the link mechanism for supporting the whetstone holding mechanism 15. The pair of swing arms 37, 38 are coupled at front ends thereof to the support shafts 35, 36 shown in FIG. 3(*a*), to freely pivot about them. The swing arms 37, 38 are supported at their base ends by the pivot shafts 39, 40 provided on the legs 21*a* of the rotary cylinder 21 so that they can be freely pivotally displaced. The pivoted cams 43, 44 are supported by pivot shafts 41, 42 supported by the slide ring 22, so that they can be freely pivotally displaced. The pivoted cam 43 is biased in a counterclockwise direction and the pivoted cam 44 is biased in a clockwise direction by respective springs, so that their cam surfaces are respectively put in contact with followers 45, 46 provided in the support block 14. In the standby state as illustrated, a tip of a pin 27*a* of the cutting edge position detecting mechanism 27 confronts the cutting edge 11*a* of the cutting blade 11. By pressing the pin 27*a* to detect the position of the tip of the pin 27*a* to abut with the cutting edge 11*a*, the position of the cutting edge 11*a* can be detected. As the process of sharpening progresses, this position of the cutting edge 11*a* gradually goes back.

The rotary whetstones 12, 13 have a base made of metal and have a generally cylindrical shape having a flange at one end thereof. The flat surfaces 12*b*, 13*b* of the rotary whetstones 12, 13 are formed by allowing abrasive material, such as for example abrasive grain, adhere to the flange surface. As described above, the pulleys 12*c*, 13*c* around which the timing belt 31 is wound are mounted to the rotation shafts 12*a*, 13*a* at the base side of the rotary whetstones 12, 13.

As shown in FIG. 5(*b*), the pair of swing arms 37, 38 are pivotally displaced, with the pivot shafts 39, 40 as centers, so that centers of the support shafts 35, 36 can move along the arcs drawn with a certain radius R. Where a center of the drive shaft 34 of the gear 33 is also set to be on the arc drawn with the same radius R, the gear 33 can be moved so that its pitch circle 33*p* is always in contact with a pitch circle 24*p* of the internal teeth of the rotation ring 24. The support block 14 of the whetstone holding mechanism 15 is supported via the four-joint link structure with the centers of the pivot shafts 39, 40 and the centers of the support shafts 35, 36 as the joints. The base ends of the pivoted arms 37, 38, which serve as two joints of the four-joint link, are fixed in position to the legs 21*a*. The position of the third joint of the four-joint link is determined by positioning one of the followers 45, 46 corresponding to one of the pivoted arms 43, 44. When the position of the third joint of the four-joint link is determined, the position of the other of the followers 45, 46, which serves as the fourth joint, is determined automatically. By guiding the followers 45, 46 properly by the pivoted cams 43, 44, the flat surfaces 12*b*, 13*b* of the rotary whetstones 12, 13 held by the support block 14 can be pivoted in a nearly parallel displacement. When an internal tooth is provided around the inside of the rotation ring 24 shown in FIG. 2 and is meshed with the gear 33, the rotational driving force applied from outside can be transmitted to the gear 33 through the rotation ring 24 and thus the rotary whetstones 12, 13 can be shifted with its rotation being kept.

FIG. 6 shows in section the structure of the cutting head 20 of FIG. 2 which is in the state in which the slide ring 22 is not locked by the lock mechanism 23. There are provided teeth around the outside of the slide ring 22 and around the inside of the lock mechanism 23 facing the slide ring 22, so that they are meshed with each other. Compressed springs 47, 48 are provided between the slide ring 22 and the pivoted cam 43 and between the slide ring 22 and the pivoted cam 44, respectively. These springs bias the pivoted cams 43, 44 so that cam surfaces of the pivoted cams 43, 44 at the side thereof can be brought into contact with the followers 45, 46.

There are provided a pair of levers 49, 50 on the back side of the cutting blade 11. These levers 49, 50 are supported at base end portions thereof by the pivot shafts 51, 52 provided on the side of the knife guide 25, with spaced a short distance, so that they can be freely pivotally displaced. The front end portions of the levers 49, 50 sandwich a projecting portion 53 on the slide ring 22 between them. A tensile spring 54 is provided between the levers 49, 50 to bias the levers 49, 50 so that the front end portions of the levers 49, 50 can sandwich the projecting portion 53 between them. This action of the levers 49, 50 can allow the slide ring 22 to follow the rotary cylinder 21 turning, so that a displacement angle of the rotary cylinder 21 to the slide ring 22 can be kept at a reference angle of 0°.

FIG. 7 shows the state in which the slide ring 22 is locked by the lock mechanism 23 and the rotary cylinder 21 is displaced with respect to the slide ring 22 in the clockwise direction of the drawing figure at only an angle of 14°. As described above, since the slide ring 22 and the lock mechanism 23 are locked by engagement between the teeth provided around the outside of the slide ring 22 and around the inside of the lock mechanism 23, the reliable lock can be provided. For the explanatory convenience, the slide ring 22 locked is angularly displaced, as illustrated with the leg 21*a* up as in FIG. 6. The follower 46 of the support block 14 is pressed rightwards of the drawing figure by the pivoted cam 44. The follower 45 is disengaged from the pivoted cam 43, so that it is not subjected to the action of the cam. The support block 14 supported by the four-joint link mechanism of FIG. 4 is moved rightwards of the drawing figure.

FIG. 8 shows the relation between the whetstone holding mechanism 15 and the cutting blade 11 of FIG. 7. When the follower 46 is pressed rightwards by the pivoted cam 44, the flat surface 13*b* of the rotary whetstone 13 is brought into contact with the other side 11*c* of the cutting edge 11*a* of the cutting blade 11. This angle of the rotary cylinder 21 is set as a contact initiation angle.

FIG. 9 shows the state in which the rotary cylinder 21 is in contact with the cutting blade 11 at an angle of 16° by being angularly changed further with respect to the slide ring 22 of FIG. 7. In this regard, when the flat surface 13*b* of the rotary whetstone 13 is put in contact with the cutting blade 11, resistance to the movement of the follower 46 becomes greater than a pressing force of the compressed spring 48 pressing the pivoted cam 44 shown in FIG. 6 and thereby the rightward movement of the flat surface 13*b* is brought to stop. As the cutting blade 11 is worn by the sharpening, the flat surface 13*b* is moved forward.

Different from FIGS. 6-7, the rotary cylinder 21 can be displaced relative to the slide ring 22 in the counterclockwise direction, to sharpen the cutting blade 11 with the rotary whetstone 12. In the support block 14 of the whetstone holding mechanism 15, the follower 45 can be pressed leftwards by the pivoted cam 43 to bring the rotary whetstone 12 into contact with the cutting blade 11. Thus, the use of the rotary whetstone 12 can also allow the sharpening of the cutting blade 11, as in the case of the use of the rotary whetstone 13.

Although the whetstone holding mechanism 15 is supported by the legs 21*a* at the bottom part of the rotary cylinder 21 in the embodiment illustrated above, since the construction is compact, the whetstone holding mechanism 15 may be properly arranged according to the construction of the cutting head 20, with less limitation on arrangement. While the whetstone holding mechanism 15 is supported by the four-joint link mechanism to allow the selective switch between the sharpening states by the turning of the R-axis, a power source, such as a motor, may be incorporated in the mechanism to move the whetstone holding mechanism automatically. While the rotary whetstones 12, 13 are also driven from outside of the rotation ring 24 through the rotation ring 24, the gear 33, and the timing belt 31, a power source, such as a motor, may be incorporated to drive the rotary whetstones.

Although the rotary whetstones 12, 13 are used for sharpening the cutting blade 11, when the cutting blade 11 is sharpened while being moved, the cutting blade may be sharpened by simply being brought into contact with the stationary whetstones. The use of the rotary whetstones 12, 13 rotating can allow the speed-up of the sharpening to avoid reduction in production efficiency caused by the sharpening. A driving source, such as a motor, may be provided in the rotary cylinder 21 to drive the rotary whetstones 12, 13. Although the cutting blade 11 has a reciprocating straight blade, even if the cutting blade 11 has a rotating round blade, the concept of the invention can be applied to at least one circumferential point, to sharpen both sides of the cutting edge of such a round blade in the same manner as in the sharpening of the cutting blade 11.

The invention claimed is:

1. A cutting machine for cutting a sheet material to be cut, which is put on a cutting table, with a cutting blade provided in a cutting head movable along the cutting table, wherein the cutting blade is used while both sides of its cutting edge are ground to keep sharpness of the cutting edge, and the cutting head is provided with:

a one side use abrasive whetstone for sharpening one side of the cutting edge of the cutting blade with its flat surface;

an other side use abrasive whetstone for sharpening the other side of the cutting edge of the cutting blade with its flat surface; and a whetstone holding mechanism that can allow selective switch between a standby state in which the one side use abrasive whetstone and the other side use abrasive whetstone are away from any of the one side of the cutting edge and the other side of the same, while the flat surface of the one side use abrasive whetstone and that of the other side use abrasive whetstone are kept in parallel with the one side of the cutting blade and the other side of the same, respectively, and an one side sharpening state in which the one side use abrasive whetstone is put in contact with the one side of the cutting edge or an other side sharpening state in which the other side use abrasive whetstone is put in contact with the other side of the cutting edge, the whetstone holding mechanism includes:

a pair of pivot shafts arranged to stand at both sides of the cutting edge of the cutting blade in spaced relation and perpendicular to the surface of the cutting table;

a pair of swing arms supported capable with swing displacement at base end portions thereof by one and the other of the pivot shafts respectively; and a support block, which is connected to support shafts at front ends of the swing arms and is supported by a four-joint link structure with the centers of the pivot shafts and the centers of the support shafts as joints, holding the flat surfaces, used for sharpening, of the one side use abrasive whetstone and the other side use abrasive whetstone parallel to the one side of the cutting blade and the other side thereof respectively.

2. The cutting machine according to claim 1, wherein said cutting head comprises:

a rotary cylinder containing the cutting blade and being capable of turning around a rotation shaft of the cutting edge perpendicular to a surface of the cutting table, to change a cutting direction of the cutting blade;

a slide ring provided on a peripheral side of the rotary cylinder so that it can follow the rotary cylinder turning in a turning direction; and a lock mechanism provided at a radial outside of the rotary cylinder so that it can lock the slide ring to the cutting head;

said whetstone holding mechanism is provided in the rotary cylinder to allow the selective switch between the standby state, and the one side sharpening state or the other side sharpening state according to a turning angle of the rotary cylinder around the rotation shaft of the cutting edge when the slide ring is locked by the lock mechanism.

3. The cutting machine according to claim 2, wherein said whetstone holding mechanism is arranged in the rotary cylinder in standing relation, and said slide ring is provided with cams for guiding the whetstone holding mechanism to positions corresponding to the standby state, the one side sharpening state, and the other side sharpening state, respectively.

4. The cutting machine according to claim 3, wherein said rotary cylinder is provided with a rotation ring which can be rotationally driven from outside and has an internal tooth around an inside thereof, said whetstone holding mechanism is equipped with a gear to engage with the internal tooth of the rotation ring, said cams are formed to guide the whetstone holding mechanism in such a manner as to change a position of the whetstone holding mechanism while keeping the engagement between the gear and the internal tooth of the rotation ring, and said one side use abrasive whetstone and said other side use abrasive whetstone are rotated by a rotational driving force transmitted from outside of the rotary cylinder to the gear through the rotation ring, to sharpen the cutting blade.

* * * * *